US006357230B1

(12) United States Patent
A'Hearn et al.

(10) Patent No.: US 6,357,230 B1
(45) Date of Patent: Mar. 19, 2002

(54) HYDRAULIC RIDE CONTROL SYSTEM

(75) Inventors: Michael A. A'Hearn, Shorewood; David J. Carlson, Chicago; Thomas J. Hajek, Jr., Lockport, all of IL (US); Andy Hatcher, Garner, NC (US); Michael D. Hudson, Plainfield, IL (US); Patrick Quinn, Garner, NC (US); Srikrishnan T. Tolappa, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/464,583

(22) Filed: Dec. 16, 1999

(51) Int. Cl.[7] ..... F16D 31/02
(52) U.S. Cl. ..... 60/413
(58) Field of Search ..... 60/413, 469; 414/673, 414/719

(56) References Cited

U.S. PATENT DOCUMENTS 3,122,246 A 2/1964 Freedy et al.
5,116,188 A * 5/1992 Kurohashi et al. ..... 60/413
5,147,172 A 9/1992 Hosseini ..... 60/43
5,195,864 A 3/1993 Drake et al. ..... 60/413
5,513,491 A 5/1996 Broenner et al.
5,706,657 A 1/1998 Ambroski et al. ..... 60/413
5,733,095 A 3/1998 Palmer et al. ..... 60/413

FOREIGN PATENT DOCUMENTS

JP 02003535 A * 1/1990 ..... 180/242

* cited by examiner

*Primary Examiner*—Edward K. Look
*Assistant Examiner*—Thomas E. Lazo
(74) *Attorney, Agent, or Firm*—J. W. Burrows; Steve M. Hanley

(57) ABSTRACT

A hydraulic ride control system is disclosed and adapted to control the ride of a machine having a load. The ride control includes an accumulator arrangement that is selectively connected with the actuator that is carrying the load to provide a cushion ride during traveling and to enable the pressure in the accumulator arrangement to be maintained substantially the same as the pressure in the actuator when raising the load and to permit the pressure in the accumulator arrangement to be lowered to that of the pressure in the actuator in the event the load is lessened. The ride control system also provides an arrangement that permits the accumulator arrangement to be bled down whenever the machine becomes disabled or when the machine is shut off.

15 Claims, 6 Drawing Sheets

HYDRAULIC RIDE CONTROL SYSTEM

TECHNICAL FIELD

This invention relates generally to a ride control system for a machine and more particularly to a control system for selectively providing a cushioned ride control.

BACKGROUND ART

In known ride control systems for machines, cushioning of the ride is controlled by an accumulator or accumulators connected in parallel to the actuator cylinders. In such machines having a bucket or such on the front or back thereof, there is a possibility that the machine will lope or bounce due to the weight of the bucket reacting to the machine traveling over rough terrain or other obstacles. It is desirable to selectively activate the ride control and not permit the bucket to have any degree of movement from its initial position and to permit any pressure in the accumulator to be bled down when the machine is shut down. Known ride control systems are often complex and give the actuators/cylinders a spongy feeling.

The present invention is directed to overcoming one or more of the problems as set forth above.

DISCLOSURE OF THE INVENTION

In one aspect of the present invention a hydraulic ride control system is provided and adapted for use in a fluid system of a machine to cushion the ride of the machine in response to initiation of a ride control mode command. The machine includes a frame with an actuator arrangement disposed between the frame and a load to raise and lower the load relative to the frame. The actuator arrangement has a raise port and a lower port and is operative upon initiation of a raise mode command to raise the load to a desired height in response to pressurized fluid being selectively directed to the raise port from a source of pressurized fluid and to exhaust fluid from the raise port to a reservoir in response to initiation of a lower mode command. The hydraulic ride control system includes an accumulator arrangement connectable to the raise port of the actuator arrangement, a first valve arrangement and a second valve arrangement. The first valve arrangement is connectable between the lower port of the actuator arrangement and the reservoir and operative to selectively connect the lower port to the reservoir in response to initiation of a ride control mode command. The second valve arrangement is disposed between the accumulator arrangement and the raise port of the actuator arrangement and operative to selectively connect the accumulator arrangement to the raise port of the actuator arrangement in response to one or both of the initiation of the raise mode command and the initiation of a ride control mode command.

BEST MODE FOR CARRYING OUT THE INVENTION

Figure 1:
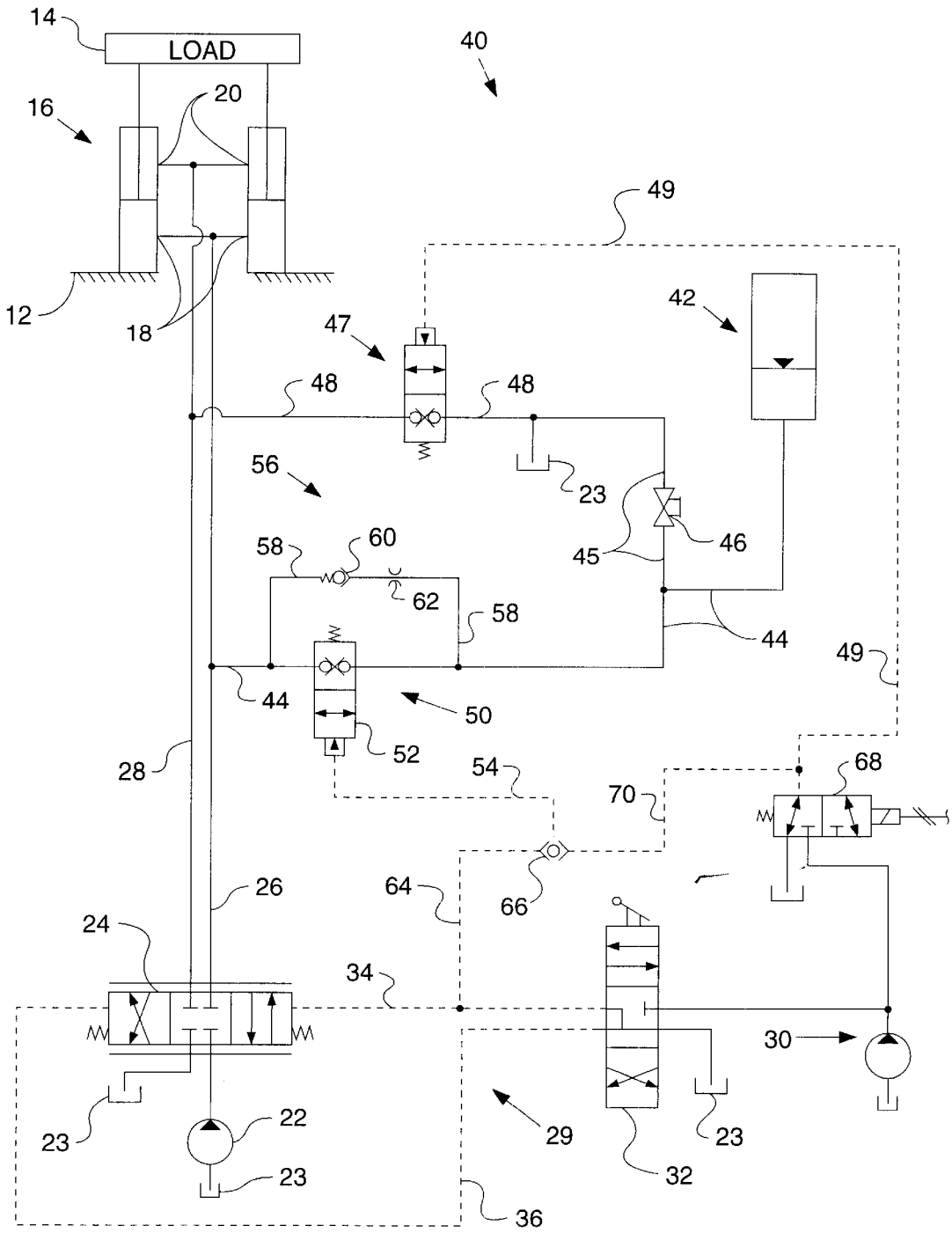
FIG. 1 is a schematic representation of a ride control system of a machine incorporating an embodiment of the subject invention.

Referring to the drawings, and more particularly to FIG. 1, a fluid system 10 is illustrated and adapted for use in a machine (not shown) to control the riding comfort of the machine. A frame 12 and a load (bucket) 14 is diagrammatically illustrated in combination with the fluid system 10.

The fluid system 10 includes an actuator arrangement 16 disposed between the frame 12 and the load 14. The actuator arrangement 16 has a raise port 18 and a lower port 20. In the subject embodiment, two hydraulic cylinders are shown but it is recognized that only one or more than two cylinders could be used. A source of pressurized fluid, such as a pump 22, receives fluid from a reservoir 23 and provides pressurized fluid through a directional control valve 24 to the actuator arrangement 16 in a conventional manner to controllably raise and lower the load. Conduits 26,28 direct the fluid flow between the directional control valve 24 and the raise and lower ports 18,20 of the actuator arrangement 16. In the subject embodiment, the movement of the directional control valve 24 is controlled by a pilot system 29. The pilot system 29 includes a source of pressurized pilot fluid 30 which directs a raise mode command and a lower mode command to the directional control valve 24 through respective pilot conduits 34,36.

A hydraulic ride control system 40 is provided and includes an accumulator arrangement 42 connected to the raise port 18 of the fluid actuator arrangement 16 through a conduit 44. The accumulator arrangement 42 is selectively connected to the reservoir 23 through a conduit 45 having a manually operated shutoff valve 46 disposed therein.

A first valve arrangement 47 is disposed in a conduit 48 between the lower port 20 of the actuator arrangement 16 and the reservoir 23. The first valve arrangement 47 is mechanically biased to a flow blocking position and movable to a flow passing position in response to receipt of a signal through a signal conduit 49 that is representing initiation of a ride control mode command.

A second valve arrangement 50 is provided and disposed in the conduit 44 between the raise port 18 and the accumulator arrangement 42. The second valve arrangement 50 includes a two position valve 52 that is mechanically biased to a flow blocking position and movable to a flow passing position in response to receipt of a command signal thereto through a conduit 54.

The second valve arrangement 50 also includes a flow restriction mechanism 56 disposed in a conduit 58 between the raise port 18 and the accumulator arrangement 42 in parallel with the two position valve 52. The flow restriction mechanism 56 of the subject embodiment includes a one-way check valve 60 disposed in the conduit 58 and is operative to permit flow from the accumulator arrangement 42 to the raise port 18 and prohibit reverse flow therethrough from the raise port 18 to the accumulator arrangement 42. A damping orifice 62 is also disposed adjacent the one-way check valve in the conduit 58 between the one-way check valve 60 and the accumulator arrangement 42.

The raise mode command is produced by controllably connecting the source of pressurized fluid 30 to the conduit 34 via a shifted valve 32. The pressure signal which represents the raise mode command is directed through a conduit 64, a resolver valve 66 and the signal conduit 54 to the two position valve 52.

The ride control mode command is produced by receiving a pressure signal from the source of pressurized pilot fluid 30 through an electrically actuated two position switching valve 68 to the signal conduit 49. The electrically actuated two position switching valve 68 is mechanically biased to a first position at which the source of pressurized pilot fluid 30 is blocked from the signal conduit 49 and the signal conduit 49 is open to the reservoir 23 and a second position at which the source of pressurized pilot fluid 30 is in communication with the signal conduit 49 and the signal conduit 49 is blocked from the reservoir 23. The ride control mode command is also directed to the two position valve 52 of the second valve arrangement 50 through a conduit 70, the resolver 66 and the conduit 54.

Figure 2:
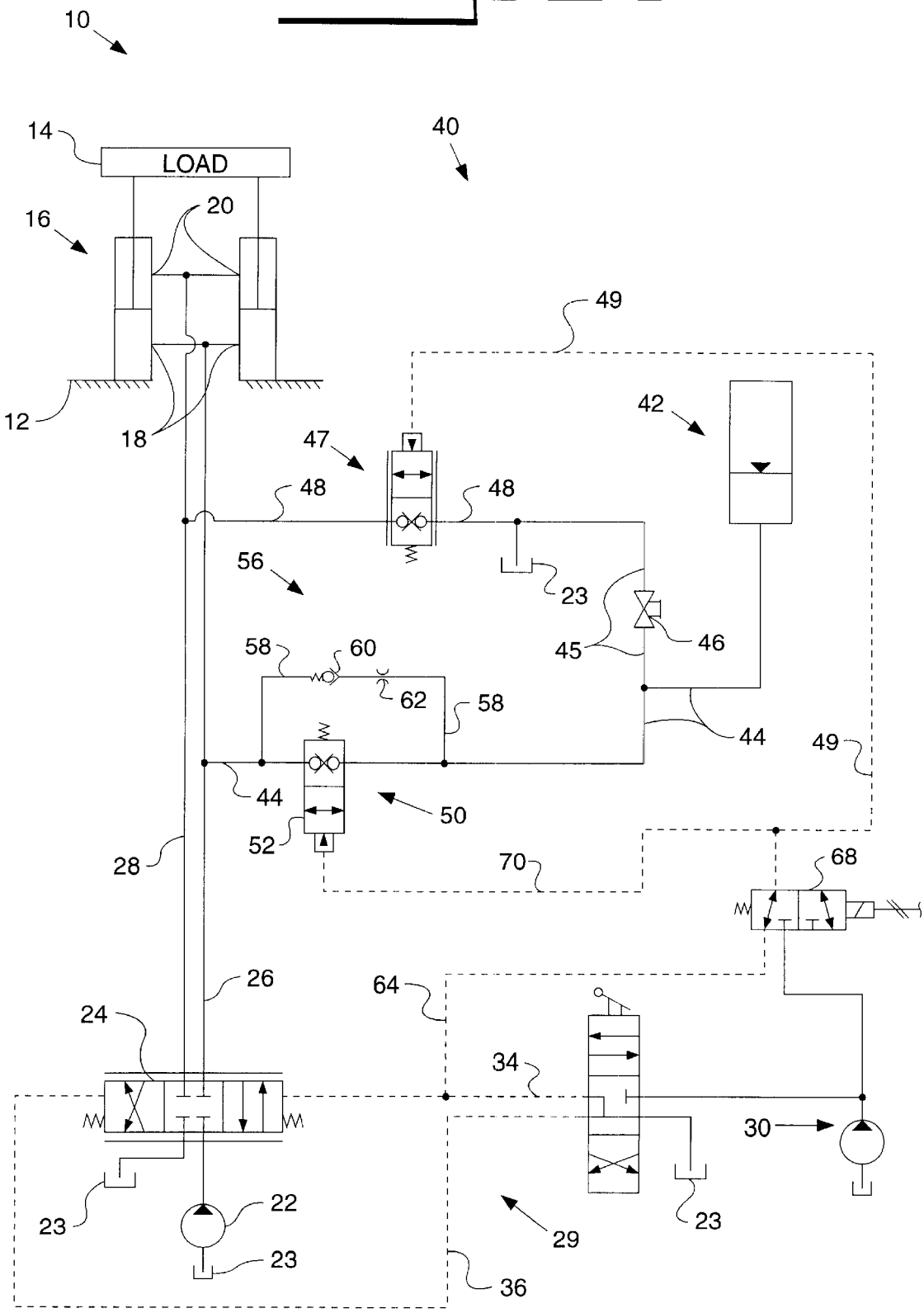
FIG. 2 is a schematic representation of a ride control system of a machine incorporating another embodiment of the subject invention.

Referring to FIG. 2 another embodiment of the subject invention is illustrated. Like elements have like element numbers. In the embodiment of FIG. 2, the first valve arrangement 47 is a two position valve that is proportionally moved from a flow blocking position towards a flow passing position in response to the ride control mode command as directed through the signal conduit 49.

In the mechanically biased position of the electrically actuated two position switching valve 68, the raise mode command is communicated through the conduit 64 across the electrically actuated two position switching valve 68 to the signal conduit 49 instead of the signal conduit 49 being connected to the reservoir 23 as set forth with respect to FIG. 1.

Figure 3:
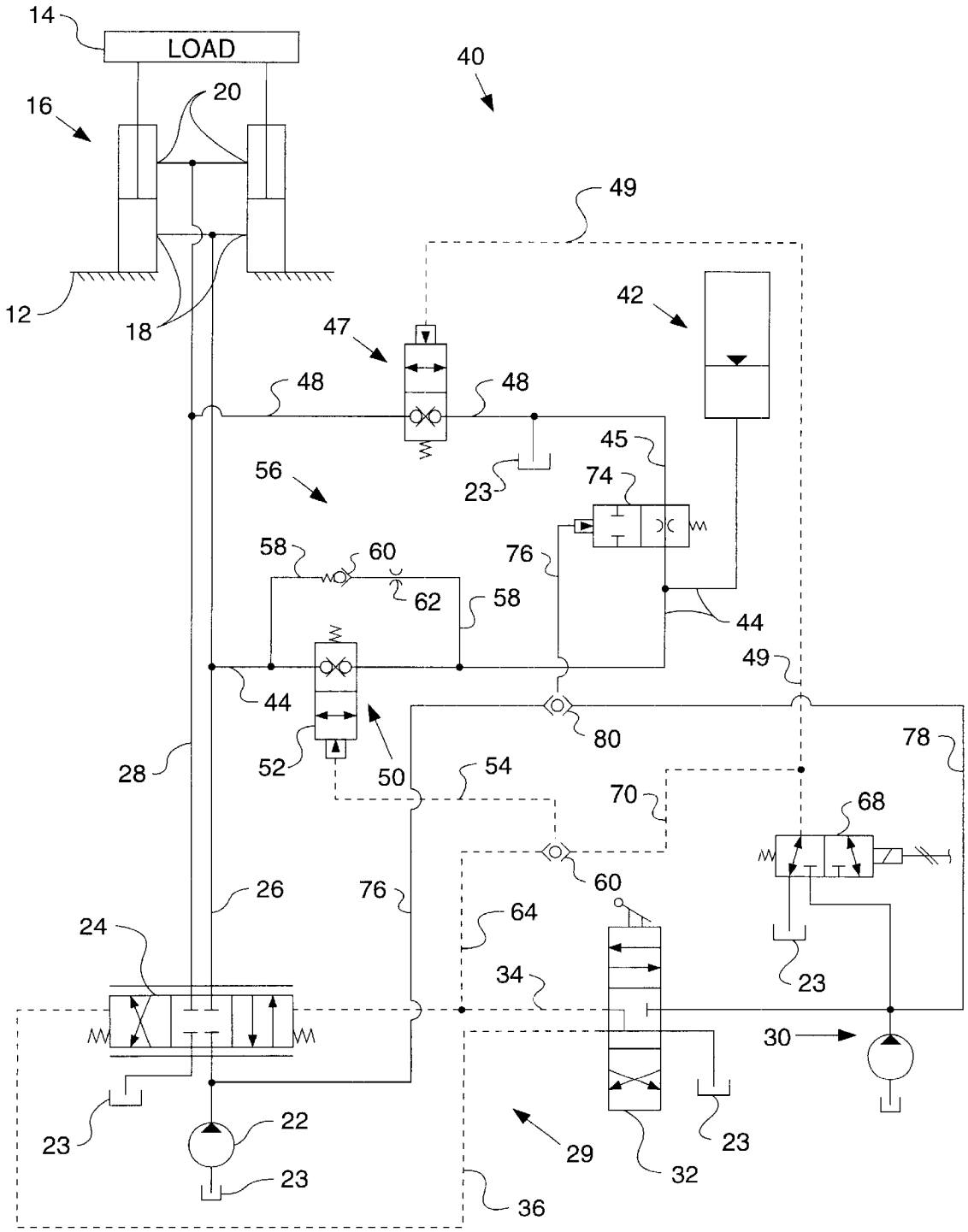
FIG. 3 is a schematic representation of a ride control system of a machine incorporating yet another embodiment of the subject invention.

Referring to FIG. 3, another embodiment of the present invention is disclosed. Like elements have like element numbers. The embodiment of FIG. 3 is very similar to that of FIG. 1. The only difference is that the manually operated shutoff valve 46 disposed between the accumulator arrangement 42 and the reservoir 23 is replaced with a two position bypass valve 74. The two position bypass valve 74 is mechanically biased to a flow passing position and movable to a flow blocking position in response to the source of pressurized fluid 22 or in response to the source of pressurized pilot fluid 30. A conduit 76 connects the source of pressurized fluid 22 to the two position bypass valve 74. The source of pressurized pilot fluid 30 is connected to the two position bypass valve 74 through a conduit 78, a resolver valve 80 and a portion of the conduit 76.

Figure 4:
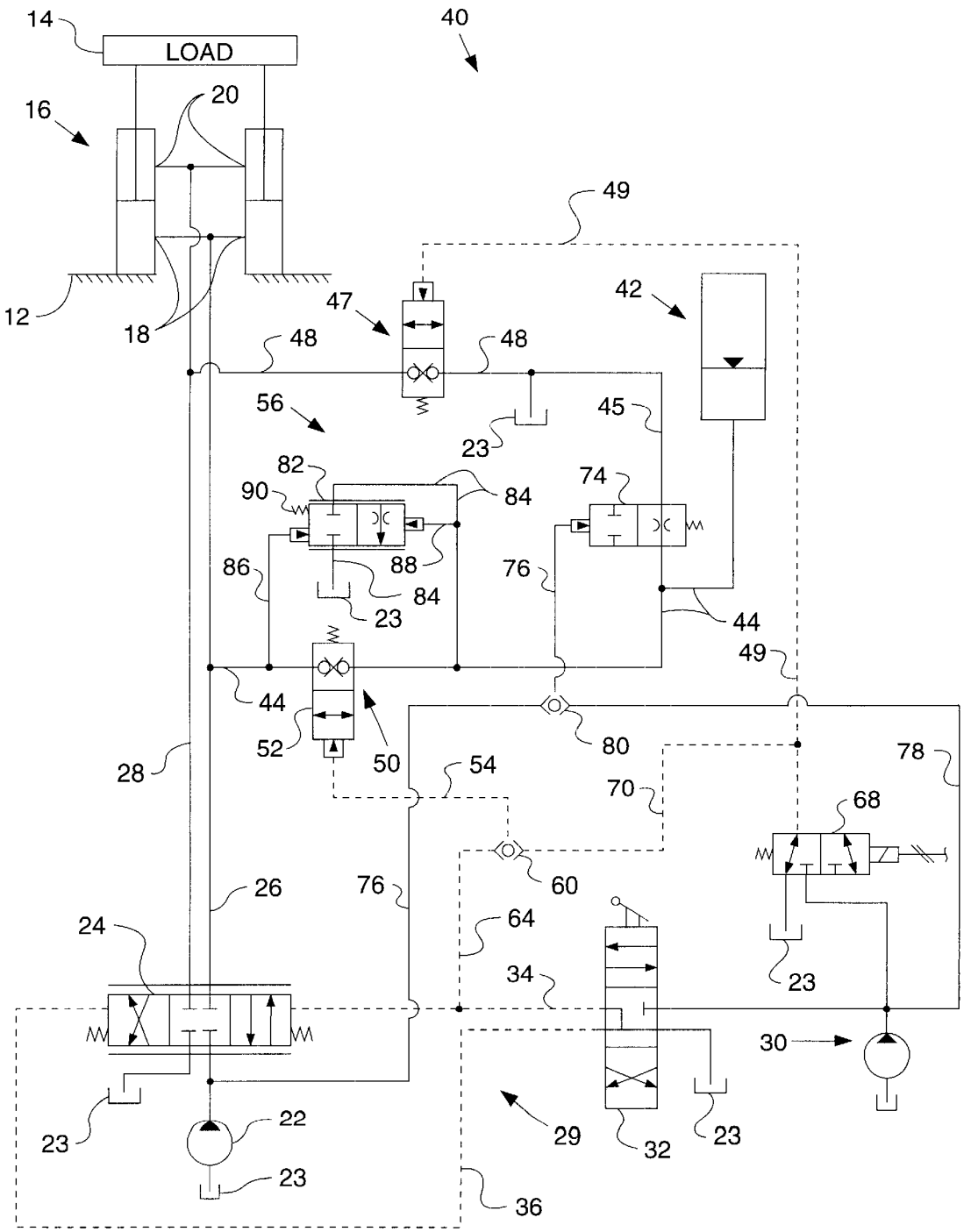
FIG. 4 is a schematic representation of a ride control system of a machine incorporating yet another embodiment of the subject invention.

Referring to FIG. 4, another embodiment of the subject invention is disclosed. Like elements have like element numbers. The embodiment of FIG. 4 is very similar to FIG. 3. The difference therebetween is that the flow restriction mechanism 56 of FIG. 4 is different. The flow restriction mechanism 56 of FIG. 4 includes a proportionally controlled two position valve 82 disposed in a conduit 84 between the accumulator arrangement 42 and the reservoir 23 and is responsive to the relationship between the pressures of fluid in the raise port 18 of the actuator arrangement 16 and the accumulator arrangement 42 through respective conduits 86,88. The proportionally controlled two position valve 82 is mechanically biased to a first position by a spring 90 and by the pressure from the raise end port 18 at which the conduit 84 from the accumulator arrangement 42 is blocked from the reservoir 23 and movable towards a second position by the pressure in the accumulator arrangement 42 at which the conduit 84 from the accumulator arrangement 42 is in communication with the reservoir 23.

Figure 5:
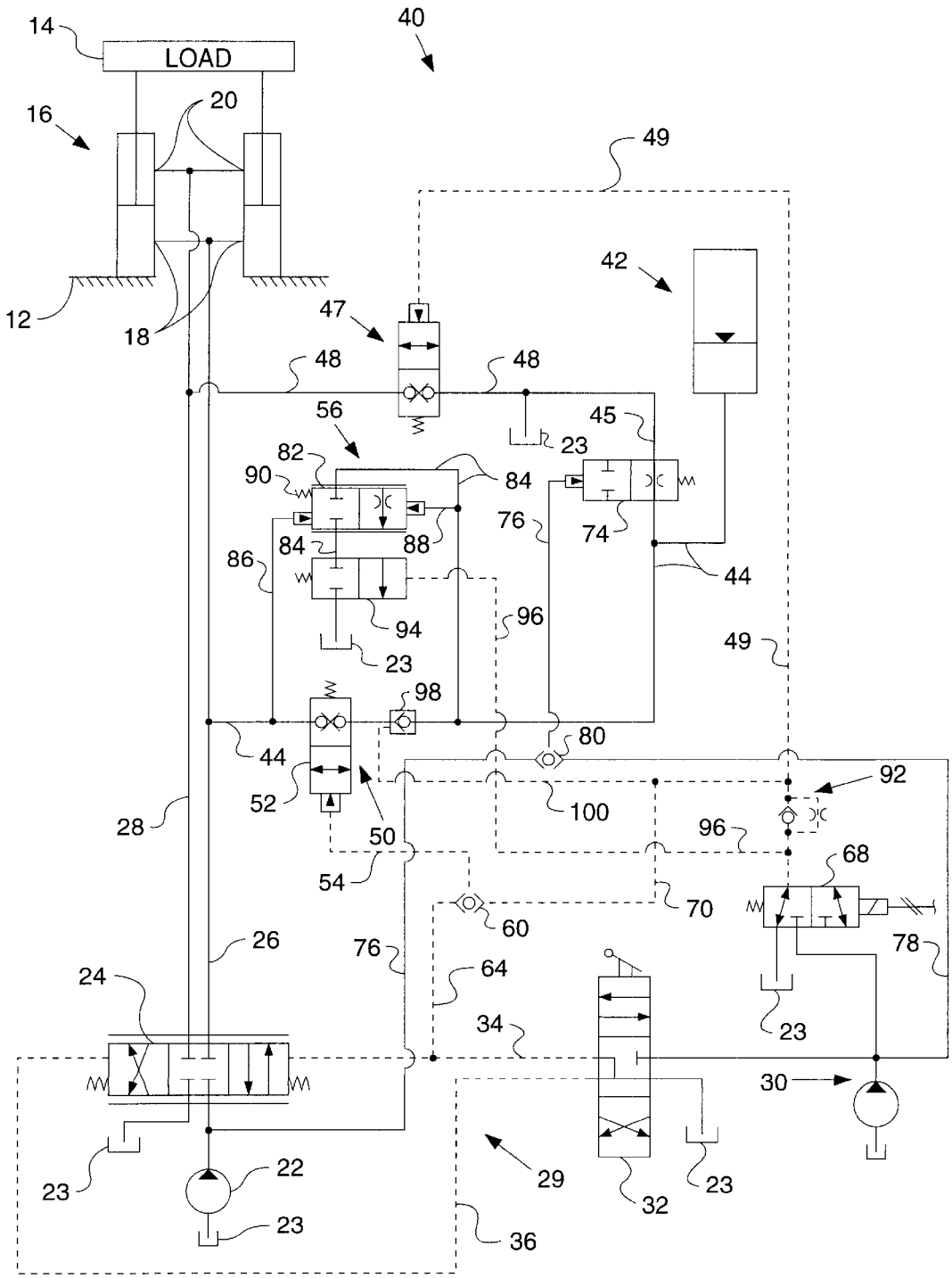
FIG. 5 is a schematic representation of a ride control system of a machine incorporating yet another embodiment of the subject invention.

Referring to FIG. 5, another embodiment of the subject invention is disclosed. Like elements have like element numbers. The embodiment of FIG. 5 is very similar to that of FIG. 4. One of the differences is that in the embodiment of FIG. 5, a choke and check valve arrangement 92 is disposed in the signal conduit 49 between the electrically actuated two position switching valve 68 and the first and second valve arrangements 47,50. The choke and check valve arrangement 92 operates in a conventional manner to permit free flow of fluid in the signal conduit 49 from the first and second valve arrangements 47,50 to the electrically actuated two position switching valve 68 and to choke/restrict the rate of flow from the electrically actuated two position switching valve 68 to the first and second valve arrangements 47,50.

Another difference is that a two position blocker valve 94 is disposed in the conduit 84 between the proportionally controlled two position valve 82 and the reservoir 23. The two position blocker valve 94 is mechanically biased to a flow blocking position and movable to a flow passing position in response to receipt of the ride control mode command delivered thereto through a signal conduit 96 that is connected to the signal conduit 49 between the electrically actuated two position switching valve 68 and the choke and check valve arrangement 92.

Additionally, a pilot operated check valve 98 is disposed in the conduit 44 generally adjacent the two position valve 52 of the second valve arrangement 50. The pilot operated check valve 98 is operative to block the flow of fluid from the accumulator arrangement 42 to the two position valve 52 in the absence of a ride control mode command and is moved to a flow passing position in response to receipt of the ride control mode command through a conduit 100 that is connected to the signal conduit 49 between the choke and check valve arrangement 92 and the first and second valve arrangements 47,50.

Figure 6:
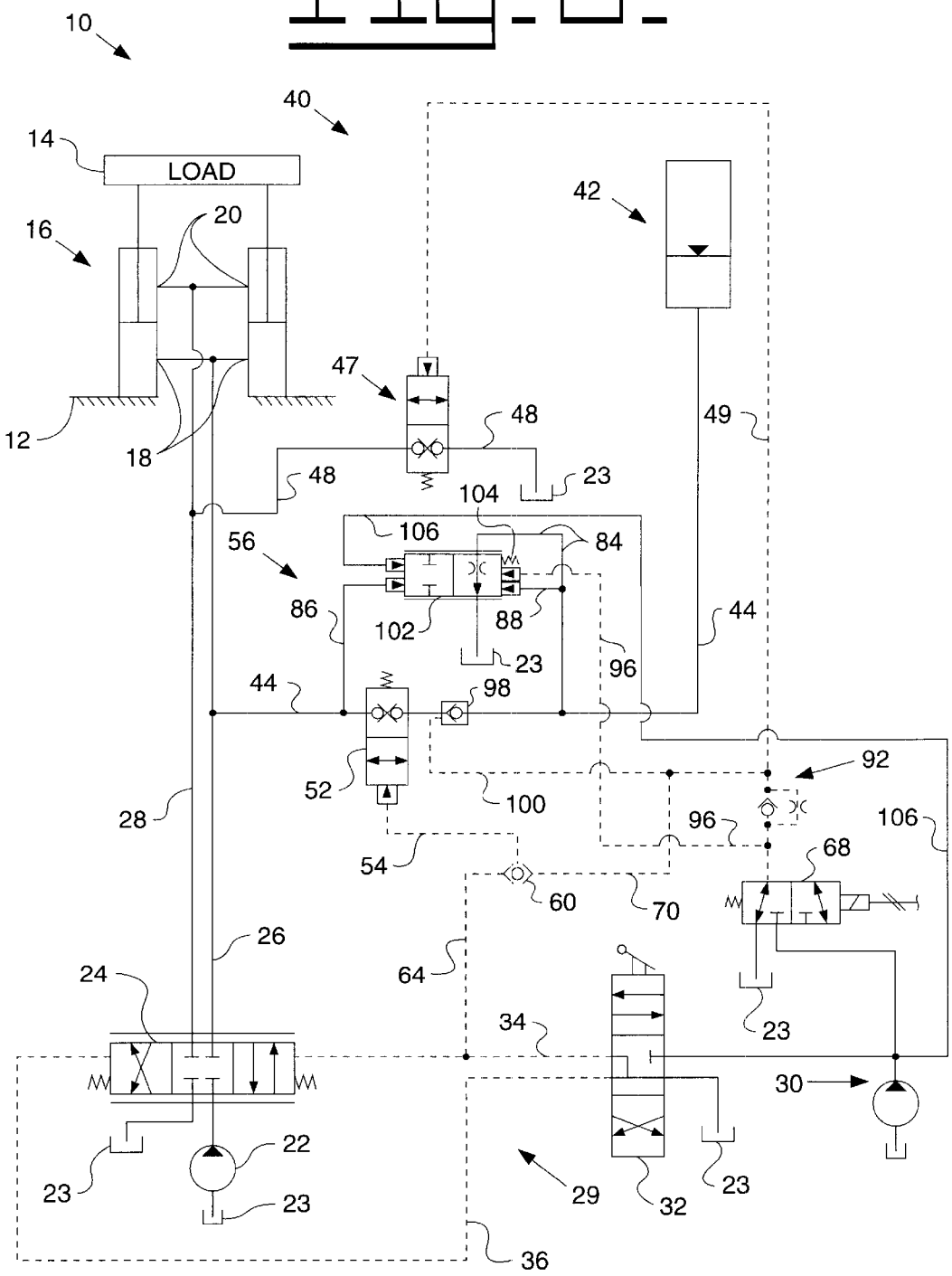
FIG. 6 is a schematic representation of a ride control system of a machine incorporating yet another embodiment of the subject invention.

Referring to FIG. 6, another embodiment of the subject invention is disclosed. Like elements have like element numbers. The embodiment of FIG. 6 is very similar to the embodiment of FIG. 5. In the embodiment of FIG. 6 the two position bypass valve 74 and the conduit 45 connecting the accumulator arrangement 42 with the reservoir has been removed along with the conduits 76,78 and associated resolver valve 80.

Additionally, the flow restriction mechanism 56 is different. The flow restriction mechanism 56 of FIG. 6 includes a single proportional valve 102 that replaces the proportionally controlled two position 82, the two position blocker valve 94, the bypass valve 74 and the conduit 45. The single proportional valve 102 is movable between a first position at which the accumulator arrangement 42 is in communication with the reservoir 23 and a second position at which the accumulator arrangement 42 is blocked from the reservoir 23. The single proportional valve 102 is mechanically biased to its first position by a spring 104, the pressure of the fluid in the accumulator arrangement 42 delivered through the conduit 88 and the ride control mode command as delivered through the conduit 96. The single proportional valve 102 is movable towards its second position in response to the pressure of the source of pressurized pilot fluid 30 as delivered through conduit 106 and the pressure in the raise port 18 of the actuator arrangement 16 as delivered through the conduit 86.

It is recognized that various other embodiments or combinations of the embodiments of FIGS. 1–6 could be used without departing from the essence of the subject invention.

For example, the first valve arrangement 47 of FIGS. 1,3–6 could be a pilot operated check valve as opposed to the two position valve set forth and described. It is also recognized that the first valve arrangement 47, the two position valve 52 of the second valve arrangement 50, the two position bypass valve 74, the proportionally controlled two position valve 82 and the two position blocker valve 94 of the flow restriction mechanism 56 could be controlled electrically by using pressure sensors to monitor operating pressures at various locations within the fluid system and delivering the sensed pressures to an electronic controller which in turn would control opening and closing the respective valves accordingly.

INDUSTRIAL APPLICABILITY

During normal operation of the fluid system as set forth in FIG. 1, the load 14 is raised and lowered in response to an input to the pilot control valve 32. The raise mode command is established by moving the pilot control valve 32 to the position to direct pressurized pilot fluid through the pilot conduit 34 to the directional control valve 24. The directional control valve in turn moves towards its operative raise position which directs pressurized fluid from the pump 22 to the raise ports 18 of the actuator arrangement 16. Fluid being exhausted from the lower ports 20 is directed across the directional control valve 24 to the reservoir 23. During normal raising and lowering of the load 14, fluid flow from the lower ports 20 of the actuator arrangement 16 through the first valve arrangement 47 to the reservoir 23 is blocked since the first valve arrangement 47 is in its flow blocking position. At the same time, fluid flow from the raise ports 18 to the accumulator arrangement 42 is permitted to pass through the two position valve 52 of the second valve arrangement 50. The two position valve 52 is moved to its flow passing position since the raise mode command is directed thereto through the conduits 64,54. Consequently, the pressure in the accumulator arrangement 42 is continuously maintained the same as the pressure of the load as measured at the load ports 18 during the raise mode.

When it is desirable to raise a load and carry it for a distance, the load is raised to a desired height and the directional control valve 24 is returned to the position illustrated in FIG. 1. At this point the two position valve 52 returns to its flow blocking position. In order to initiate the hydraulic ride control system 40, an electrical signal is directed to the two position switching valve 68 moving it to the position to connect the source of pressurized pilot fluid 30 to the signal conduit 49 thus initiating the ride control mode command. The ride control mode command is directed simultaneously to the first valve arrangement 47 and the two position valve 52 of the second valve arrangement 50 moving each of them to their respective flow passing positions.

With the first valve arrangement 47 in its flow passing position, flow is free to travel therethrough between the lower ports 20 and the reservoir 23. Likewise, flow is free to pass between the accumulator arrangement 42 and the raise ports 18 across the two position valve 52. Since the accumulator arrangement 42 was pre-charged during the raise mode, there is no movement of the load as the two position valve 52 moves to its open position to connect the raise ports therewith. As the machine travels along its path, the accumulator arrangement 42 absorbs any bouncing or shocks induced by the load so that the machine is not subjected to sudden shocks or bouncing.

When the ride control mode is de-activated, the two position valve 68 returns to its mechanically biased position which vents the signal conduit 49 to the reservoir 23. As a result thereof, the first valve arrangement 47 and the two position valve 52 return to their respective flow blocking positions. If the load is lightened by, for example, a portion of the load being dumped, the pressure in the raise ports 18 is proportionally reduced. Once the pressure in the raise ports 18 lessens, the higher pressure in the accumulator arrangement 42 is lowered to match the pressure in the raise ports 18 by bleeding down through the orifice 62 and the one way check valve 60. Therefore, in the event it is desirable to subsequently activate the ride control, there is not sudden movement of the load since the pressure of the load is substantially the same as the pressure in the accumulator arrangement 42.

In the event the machine becomes disabled with the accumulator arrangement 42 charged to a high level, the pressure in the accumulator arrangement 42 can be bled down by opening the manually operated shutoff valve 46.

The operation of the embodiment of FIG. 2 is the same as that of FIG. 1 with respect to normal raise and lower operations. Likewise, the operation of the ride control system 40 operates in the same manner. The only difference between the operation of the two embodiments is that during the raise mode with the ride control de-activated, the raise mode command is directed through the electrically actuated switching valve 68 to both the first valve arrangement 47 and the two position valve 52 of the second valve arrangement 50. The raise mode command moves the two position valve 52 to its flow passing position so that the pressure in the raise ports 18 is connected to the accumulator arrangement 42 thus equalizing the pressures therebetween. At the same time, the raise mode command moves the first valve arrangement 47 towards its flow passing position in proportion to the magnitude of the raise mode command. This permits the flow from the lower ports 20 to controllably pass to the reservoir 23 thereacross. The remainder of the operation is the same as that with respect to FIG. 1.

The operation of the embodiment of FIG. 3 is the same as that with respect to FIG. 1 with the exception that the manually operated shutoff valve 46 has been replaced with the two position bypass valve 74. During normal operation with either the source of pressurized fluid or the source of pressurized pilot fluid operational, the two position bypass valve 74 is maintained in its flow blocking position. It is recognized that either of the sources of pressurized fluid could be solely connected to the bypass valve 74. If the machine becomes disabled so that the associated source of pressurized fluid 22/30 is not producing fluid flow, the bypass valve 74 is mechanically urged to its flow passing position thus connecting the accumulator arrangement 42 with the reservoir 23.

The operation of the embodiment of FIG. 4 is the same for normal operation and operation of ride control as that with respect to FIG. 1. The major difference in the operation of the embodiment of FIG. 4 is in balancing the pressure in the accumulator arrangement 42 with respect to the pressure in the raise ports 18. In the embodiment of FIG. 4, in the event the load is lessened by removing a portion of the load, the pressure in the raise ports 18 is likewise lowered, If the raise ports 18 were connected to the accumulator arrangement 42 under these conditions, as in FIGS. 1–3, the load would slightly move upward until the pressures are equalized. But in FIG. 4, with the pressure in the raise ports 18 at a lower level than that of the pressure in the accumulator arrangement 42, the difference in the respective pressures acting on the proportionally controlled two position valve 82 moves the proportionally controlled two position valve 82 towards its flow passing position thus bleeding off pressurized flow from the accumulator arrangement 42 through the conduit 84 to the reservoir 23. Once the respective pressures in the raise ports 18 and the accumulator arrangement 42 are again balanced the proportional valve 82 returns towards its flow blocking position to maintain the pressure balance therebetween.

The operation of FIG. 5 is similar for normal operation and operation of ride control as that with respect to FIG. 1. The operation of the proportionally controlled two position valve 82 is the same as that with respect to FIG. 4. However, in the operation of the embodiment of FIG. 5, the two position blocker valve 94 prohibits the flow from the proportionally controlled two position valve 82 to pass therethrough when the system is being operated with the ride control mode de-activated. Consequently, if the load has been lessened during normal operation, the pressure in the accumulator arrangement 42 is maintained higher than that in the raise ports 18. Once the ride control mode is activated, the two position blocker valve 94 is moved to its flow passing position.

In order to provide a slight time delay between activating the ride control mode which moves the blocker valve 94 to its flow passing position and the opening of the two position valve 52 of the second valve arrangement 50, the choke and check valve arrangement 92 is disposed in the signal conduit 49 downstream of the connection with the blocker valve 94 and upstream of the connection with the first and second valve arrangements 47,50. Since the ride control mode command to the first and second valve arrangements is choked/restricted, the bypass valve 94 opens first to permit pressure balancing between the raise ports 18 and the accumulator arrangement 42 prior to the raise ports 18 being placed in communication with the accumulator arrangement 42 across the two position valve 52.

The addition of the pilot operated check valve 98 adjacent the two position valve 52 operates to permit holding of a higher pressure in the accumulator arrangement 42 during normal operation when the load is being raised without the ride control being activated. The use of the pilot operated check valve 98 helps extend the life of the accumulator arrangement 42. By keeping the pressure in the accumulator arrangement 42 from continuously increasing and decreasing due to normal operation, the life of the accumulator arrangement 42 is increased. Initiation of the ride control mode command directs a signal to the pilot operated check valve 98 moving it to its open position thus permitting free flow between the raise ports 18 and the accumulator arrangement 42.

The operation of the embodiment of FIG. 6 is the same as that for FIG. 5 during normal operation and during the ride control mode of operation. The flow restriction mechanism 56 of FIG. 6 is a single proportional valve 102 that is operative to provide the functions of the flow restriction mechanism 56 and the two position bypass valve 74 of FIG. 5. The pressures of the fluid in the accumulator arrangement 42 and the raise ports 18 are equalized by the pressure relationship of the respective pressures being directed to the proportional valve 102 and controllably venting a portion of the pressure in the accumulator arrangement 42 if the load is lessened. Since the pressure of the source of pressurized pilot fluid 30 is acting on the proportional valve 102 urging it to its flow blocking position, the pressure balancing of the accumulator arrangement 42 and the raise ports 18 cannot happen until the cushion ride mode is activated. Once the cushion ride mode is activated, the cushion ride mode command is directed to the proportional valve 102 through the conduit 96 in opposition to the force created by the source of pressurized pilot fluid 30 acting on the other end. Consequently, thereafter, the proportional valve 102 can function to equalize the pressures between the raise ports 18 and the accumulator arrangement 42.

Likewise, since the source of pressurized pilot fluid 30 is acting on the proportional valve 102 urging it towards its flow blocking position and the cushion ride control mode command is acting to urge it towards the flow passing position and the ride control mode command is established by the source of pressurized pilot fluid 30, absence of the source of pressurized pilot fluid 30 permits the combined forces of the pressure of the fluid in the accumulator arrangement 42 and the mechanical biasing spring 104 to urge the proportional valve 102 to its flow passing position to bleed-off the pressure in the accumulator arrangement 42 in the event that the machine is disabled.

From the foregoing, it is readily apparent that the subject hydraulic ride control system 40 provides a cushion ride arrangement for a machine that permits the pressure in the accumulator arrangement 42 to be equalized with the pressure of the fluid in the raise ports 18 and to permit the accumulator arrangement 42 to be bled down in the event that the machine is disabled.

Other aspects, objects and advantages of the invention can be obtained from a study of the drawings, the disclosure and the appended claims.

What is claimed is:

1. A hydraulic ride control system adapted for use in a fluid system of a machine to cushion the ride of the machine in response to initiation of a ride control mode command, the machine having a frame with an actuator arrangement disposed between the frame and a load to raise and lower the load relative to the frame, the actuator arrangement having a raise port and a lower port, the actuator arrangement being operative upon initiation of a raise mode command to raise the load to a desired height in response to pressurized fluid being selectively directed to the raise port from a source of pressurized fluid and to exhaust fluid from the lower port to a reservoir in response to initiation of a lower mode command, the hydraulic ride control system comprising:

an accumulator arrangement connectable to the raise port of the actuator arrangement;

a first valve arrangement connectable between the lower port of the actuator arrangement and the reservoir and operative to selectively connect the lower port to the reservoir in response to initiation of a ride control mode command;

a second valve arrangement disposed between the accumulator arrangement and the raise port of the actuator arrangement, the second valve arrangement being operative to selectively connect the accumulator arrangement to the raise port of the actuator arrangement and being operative in response to initiation of the ride control mode command to selectively connect the accumulator arrangement to the raise port of the actuator arrangement.

2. The hydraulic ride control system of claim 1 wherein the second valve arrangement is a two position valve that is mechanically biased to a flow blocking position, the two position valve is movable to a flow passing position in response to initiation of the raise mode command and is movable to a flow passing position in response to initiation of the ride control mode command.

3. The hydraulic ride control system of claim 2 wherein the second valve arrangement includes a flow restriction mechanism connectable between the accumulator arrangement and the raise port of the actuator arrangement in parallel with the two position valve.

4. The hydraulic ride control system of claim 3 wherein the flow restriction mechanism is a one way check valve which permits flow away from the accumulator arrangement towards the raise port of the actuator arrangement and prohibits reverse thereto.

5. The hydraulic ride control system of claim 3 wherein the flow restriction mechanism is a proportionally controlled two position valve that controllably directs pressurized fluid from the accumulator arrangement to the reservoir responsive to the relationship between the pressure of the fluid in the accumulator arrangement and the pressure of the fluid in the raise port of the actuator arrangement.

6. The hydraulic ride control system of claim 5 wherein the flow restriction mechanism also includes a two position blocker valve disposed between the proportionally controlled two position valve and the reservoir, the two position blocker valve is mechanically biased to a flow blocking position and movable to a flow passing position in response to initiation of the ride control mode command.

7. The hydraulic ride control system of claim 5 wherein the proportionally controlled two position valve is also movable towards the position to direct flow from the accumulator arrangement to the reservoir in response to initiation of the ride control mode command.

8. The hydraulic ride control system of claim 3 wherein the first valve arrangement is biased to a flow blocking position and proportionally movable towards a flow passing position in response to initiation of the raise mode command.

9. A hydraulic ride control system adapted for use in a fluid system of a machine to cushion the ride of the machine in response to initiation of a ride control mode command, the machine having a frame with an actuator arrangement disposed between the frame and a load to raise and lower the load relative to the flame, the actuator arrangement having a raise port and a lower port, the actuator arrangement being operative upon initiation of a raise mode command to raise the load to a desired height in response to pressurized fluid being selectively directed to the raise port from a source of pressurized fluid and to exhaust fluid from the lower port to a reservoir in response to initiation of a lower mode command, the hydraulic ride control system comprising:

an accumulator arrangement connectable to the raise port of the actuator arrangement;

a first valve arrangement connectable between the lower port of the actuator arrangement and the reservoir and operative to selectively connect the lower port to the reservoir and controllably vent the accumulator arrangement to the reservoir in response to initiation of a ride control mode command;

a second valve arrangement disposed between the accumulator arrangement and the raise port of the actuator arrangement and operative to selectively connect the accumulator arrangement to the raise port of the actuator arrangement in response to one of the initiation of the raise mode command and the initiation of a ride control mode command.

10. The hydraulic ride control system of claim 9 wherein a manually operated control valve is disposed between the accumulator arrangement and the reservoir.

11. The hydraulic ride control system of claim 9 wherein a two position bypass valve is disposed between the accumulator arrangement and the reservoir, the two position bypass valve is mechanically biased to a flow passing position and adapted for movement to a flow blocking position in response to pressurized fluid from the source of pressurized fluid.

12. The hydraulic ride control system of claim 11 including a source of pressurized pilot fluid and the two position bypass valve is movable to the flow blocking position in response to one of the source of pressurized fluid and the source of pressurized pilot fluid.

13. A hydraulic ride control system adapted for use in a fluid system of a machine to cushion the ride of the machine in response to initiation of a ride control mode command, the machine having a frame with an actuator arrangement disposed between the frame and a load to raise and lower the load relative to the frame, the actuator arrangement having a raise port and a lower port, the actuator arrangement being operative upon initiation of a raise mode command to raise the load to a desired height in response to pressurized fluid being selectively directed to the raise port from a source of pressurized fluid and to exhaust fluid from the lower port to a reservoir in response to initiation of a lower mode command, the hydraulic ride control system comprising:

an accumulator arrangement connectable to the raise port of the actuator arrangement;

a first valve arrangement connectable between the lower port of the actuator arrangement and the reservoir and operative to selectively connect the lower port to the reservoir in response to initiation of a ride control mode command;

a second valve arrangement disposed between the accumulator arrangement and the raise port of the actuator arrangement and operative to selectively connect the accumulator arrangement to the raise port of the actuator arrangement in response to one of the initiation of the raise mode command and the initiation of a ride control mode command;

a source of pressurized pilot fluid and wherein initiation of the ride control mode command includes an electrically actuated two position switching valve connected to the source of pressurized pilot fluid and operative to direct pressurized pilot fluid therefrom to the first and second valve arrangements in response to an electrical input signal requesting actuation of the ride control system; and a choke and check valve arrangement disposed between the electrically actuated two position switching valve and the first and second valve arrangements, the choke and check valve arrangement is operative to permit free flow of fluid from the first and second valve arrangements to the electrically actuated two position switching valve and to choke or restrict the rate of flow from the electrically actuated two position switching valve towards the first and second valve arrangements.

14. The hydraulic ride control system of claim 13 including a pilot operated check valve disposed between the accumulator arrangement and the second valve arrangement and operative to prohibit flow from the accumulator arrangement to the second valve arrangement in the absence of a pressure signal from the electrically actuated two position switching valve and to permit flow from the accumulator arrangement to the second valve arrangement in response to a pressure signal from the electrically actuated two position switching valve.

15. The hydraulic ride control system of claim 14 wherein the pressure signal from the electrically actuated two position switching valve to the pilot operated check valve is delivered from a location between the electrically actuated two position switching valve and the choke and check valve arrangement.

* * * * *